US005183097A

United States Patent [19]

Boudot

[11] Patent Number: 5,183,097

[45] Date of Patent: Feb. 2, 1993

[54] EQUIPMENT INSTALLATION FOR POSITIONING AND CLAMPING FOUNDRY MOLDS

[75] Inventor: Daniel Boudot, Saint-Remy, France

[73] Assignee: Pont-A-Mousson S.A., Nancy, France

[21] Appl. No.: 750,350

[22] Filed: Aug. 27, 1991

[30] Foreign Application Priority Data

Aug. 27, 1990 [FR] France ..... 90 10799

[51] Int. Cl.[5] ..... B22D 18/04

[52] U.S. Cl. ..... 164/306; 164/323

[58] Field of Search ..... 164/306, 119, 323

[56] References Cited

FOREIGN PATENT DOCUMENTS 61532 10/1982 European Pat. Off. .
1344310 10/1963 France .
2295808 7/1976 France .
2533847 4/1984 France .
726355 3/1955 United Kingdom .
1238700 7/1971 United Kingdom ..... 164/306

*Primary Examiner*—Kuang Y. Lin
*Attorney, Agent, or Firm*—Sughrue, Mion, Zinn, Macpeak and Seas

[57] ABSTRACT

Quickly dismountable foundry mold positioning and clamping equipment installation. The casting station, positioned on the molten metal feed spout 16 of a supply crucible or furnace, comprises a sand mold 2 supported by a frame 1 and having a melt passage 3 opening facing downwardly, a mechanism 4 for implementing side-travel transfer of the frame, a suspension jack 18 mounted in the transfer mechanism, and a clamping jack 12 for urging the mold against support ledges defined by rotatable tappets 8 carried by the frame.

7 Claims, 1 Drawing Sheet

EQUIPMENT INSTALLATION FOR POSITIONING AND CLAMPING FOUNDRY MOLDS

BACKGROUND OF THE INVENTION

This invention concerns an equipment installation for positioning and clamping foundry molds More specifically, it concerns a positioning and clamping equipment installation for foundry molds for low-pressure bottom casting with metal alloy at a casting station in proximity to a metal alloy fusion apparatus.

The height of travel of the molds must be adjustable. Furthermore, the most effective clamping possible must be obtained without leakage of the liquid metal.

SUMMARY OF THE INVENTION

In order to retain the same installation for several casting procedures using different molds, this invention proposes a clamping installation that can be used for molds of various sizes, since sand molds, each of which comprises a melt passage that opens facing downwardly and which is fed by a casting spout upstanding from a metal alloy supply ladle, as well as means for setting the base of the melt passage on the upper opening of the casting spout, may be of different heights, depending on the particular configuration.

To this end, the equipment installation according to the invention comprises at least one recessed mold-support frame for a sand mold having a melt passage opening facing downwardly, a mechanism for side-travel transfer, at least one substantially vertical suspension jack, and at least one substantially vertical clamping jack, the melt passage opening being positioned over the casting spout of the supply ladle or furnace.

Preferably, the installation allows repetitive casting procedures in which the transfer mechanism incorporates a device for gripping and suspending the frame, and the frame-gripping and frame-suspension device belonging to the transfer mechanism bears the jack by means of which an upper plate of the frame is suspended. On this plate the clamping jack, the head of which is pointed downwardly, is connected, while remaining free to rotate, to a clamping plate by means of a swivel joint.

In accordance with other features:

the upper, substantially horizontal plate of the frame is connected in stationary fashion to at least two mold-suspension rods which extend downward in a substantially vertical fashion and each of which is fitted, at its lower end, with a substantially horizontal rotating tappet which supports a mold-support plate of the mold. Each tappet is rotatably displaceable between a frame-open position and a closed, or engaged, position beneath the lower surface of the mold-support plate; and the lower surface of a mold is set on a casting spout and, at the casting station, it is set over the upper surface of an intermediate wear device to provide complete impermeability.

To keep the mold-support plate horizontal, the frame is guided vertically by at least one vertical rod. Moreover, the tappets are adjustable so that their support surfaces form a horizontal plane on which the mold-support plate is placed. This plane is perpendicular to the vertical rod.

A further object of the invention is to provide a positioning and clamping equipment installation for sand molds used for bottom casting with metal alloy, the sand mold comprising a melt passage opening facing downwardly and fed by a casting spout connected to a metal-alloy pouring ladle, and means for setting the melt passage over the upper opening of the casting spout, the installation conforming to the description provided above.

BRIEF DESCRIPTION OF THE DRAWINGS

The single drawing figure is a schematic representation of a foundry installation in accordance with the invention.

DETAILED DESCRIPTION OF THE PREFERRED EMBODIMENT

Figure 1:
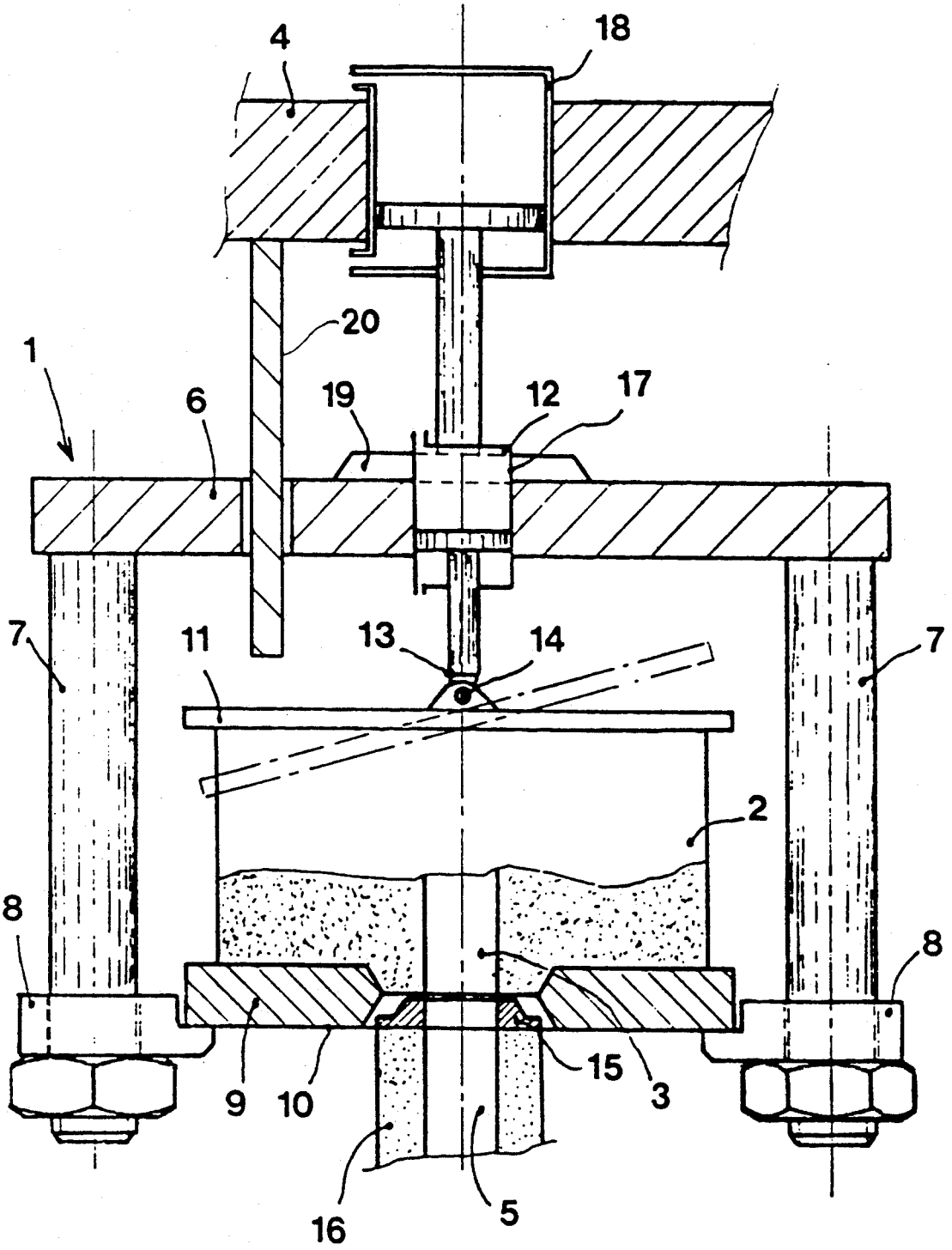

The equipment installation illustrated in the drawing comprises a frame 1 in which a sand mold 2 having a melt passage 3 opening facing downwardly is secured. The installation is of the type allowing repetitive casting procedures, and further comprises a conventional horizontal transfer mechanism 4, such as that described in commonly assigned French Patent No. 2,533,847. The transfer mechanism carries, according to the invention, a device for gripping and suspending the frame. The installation is designed to automatically position and clamp, during repeated procedures, a mold 2 on a bottom-casting channel 5.

The upper part of the frame 1 comprises an upper plate 6 which is substantially horizontal and rectangular. The plate 6 is connected in a stationary fashion to four mold-suspension rods 7 (two of which are not shown) which extend vertically downwardly. Each rod incorporates, at its lower end, a rotatable horizontal tappet 8 designed to support a mold-support plate 9, each tappet 8 being rotatably displaceable between a frame-open position, and a closed or engaged position beneath a lower surface 10 of the mold-support plate 9. The sand mold 2 is centered on the mold-support plate 9 and clamped between such plate and an upper clamping plate 11 by a dual-action clamping jack 12 whose head 13, pointed downwardly, is connected, while remaining free to rotate, to the clamping plate 11 of the mold by a swivel joint 14. The body 17 of the jack 12 is connected to the plate 6. The pivoting or rotation allowed by the swivel joint enables the use of a mold whose upper surface (shown by dot-dash lines) lies in a plane inclined to the plane of the lower surface, the lower surface of the upper plate 11 being larger than, or of the same size as, the upper surface of the mold 2.

At the casting station, the mold 2 is seated on the upper surface of a readily replaceable, intermediate wear device or collar 15.

The frame 1 is movable vertically and horizontally by the transfer mechanism 4. The transfer mechanism 4 carries a device for gripping and suspending the frame, such device comprising a dual-action jack 18 designed for the suspension of the upper plate 6 of the frame 1, and a vertical rod 20 for guiding the frame. The jack 18 is pointed downwardly and its head 19 is releasably or fixedly coupled to the frame.

To prepare for a positioning and casting operation, the mold 2 is moved by a conveyor device to a position inside the frame 1, the tappets 8 being in the open position. The tappets 8 are then rotated into the engaged position. The mold can no longer travel outside the frame. The tappets are adjusted so that their support surfaces and the lower part of the mold-support plate 9 lie in the same horizontal plane. The melt passage 3 of the mold opens out into the atmosphere.

Next, the clamping jack 12 is actuated to push against the mold 2 and clamp it to the frame, the mold having undergone no movement in relation to the frame 1. The side-travel transfer mechanism 4 is then controlled or manipulated to place the frame 1 containing the clamped mold 2 above a feed spout 16, whereafter the jack 18 is actuated to lower the frame 1 so as to place the mold 2 in the casting position, in engagement with the collar 15.

During the entire interval during which the mold 2 is held in the casting position, to ensure that the mold will not be raised within the frame, thereby causing leakage of the liquid metal, the clamping jack 12 remains pressurized to exert a downward force which is greater than the force exerted by the pressurized suspension jack (or jacks) 18 for positioning and retaining the mold 2 on the intermediate wear collar 15.

After casting, since the jacks 12 and 18 are dual-action jacks, all of the operations described above are effected in inverse order. Another mold is then transported inside the frame 1 in preparation for the next casting operation. The height of the second mold may be different from that of the first, the travel of the jack 12 being adjusted to such variable mold height.

I claim:

1. A dismountable positioning and clamping equipment installation for foundry molds (2) designed to implement the bottom casting of metal alloy at a casting station proximate to a metal alloy supply ladle, said installation comprising: at least one mold-support frame (1), a sand mold having a melt passage (3) opening facing downwardly, a mechanism (4) for side-travel transfer of the frame, at least one substantially vertical suspension jack (18) mounted to the transfer mechanism, and at least one substantially vertical clamping jack (12) mounted to the frame, the mold being adapted to be positioned over a casting spout (16) of a fusion apparatus, and the frame comprising rotatably displaceable tappets (8) and at least one mold support plate (9), support surfaces of the tappets and a lower surface of the mold support plate lying in a single horizontal plane.

2. An installation according to claim 1, allowing repetitive casting operations and in which the transfer mechanism supports a device for gripping and suspending the frame, wherein the frame-gripping and frame-suspension device incorporates the suspension jack (18) which suspends an upper plate (6) of the frame, said upper plate incorporating the clamping jack (12), and a downwardly directed head (13) of the clamping jack being pivotally connected to a mold clamping plate (11) by a swivel joint (14).

3. An installation according to claim 2, wherein the upper plate (6) of said frame is connected in stationary fashion to at least two mold suspension rods (7) which extend downwardly in substantially vertical fashion and each of which comprises, at a lower end thereof, one of said tappets which supports the mold support plate (9), each tappet being rotatable between a frame-open position and a closed, or engage, position beneath the lower surface (10) of the mold support plate.

4. An installation according to claim 3, wherein a lower surface of a mold is disposed over the casting spout, and at the casting station, the mold is seated on an upper surface of an intermediate wear collar (15).

5. An installation according to claim 4, further comprising means for enabling the clamping jack (12) to exert a downward pressure which is greater than the pressure exerted by the suspension jack on the intermediate wear collar.

6. An installation according to claim 2, wherein the frame (1) is guided vertically by at least one vertical rod.

7. A dismountable positioning and clamping apparatus for foundry molds, comprising:

a) a mold support frame (1) having a horizontal upper plate (6), a plurality of rods (7) individually extending downwardly from corners of the plate, a plurality of rotatably displaceable tappets (8) individually mounted to lower ends of the rods and defining support shoulders, and a clamping jack (12) centrally mounted to the plate and having a piston rod extending downwardly and pivotally coupled at a lower end thereof to a mold clamping plate (11), b) a sand mold (2) having a melt passage (3) opening facing downwardly and adapted to be seated on an upper end of a molten metal feed spout (16), and a lower support plate (9) adapted to be seated on the tappet shoulders of the frame, the mold thus being removably disposed within the frame and retained therein by being clamped between the tappet shoulders and the clamping plate by the clamping jack, and c) a horizontally movable transfer mechanism including a support beam (4) disposed above the frame, a suspension jack (18) mounted to the beam and having a downwardly extending piston rod, and means (19) mounting a lower end of said piston rod to the upper plate of the frame.

* * * * *